US006019526A

United States Patent [19]

Herbert

[11] Patent Number: 6,019,526

[45] Date of Patent: Feb. 1, 2000

[54] THERMAL PRINTING APPARATUS

[75] Inventor: Raymond John Herbert, Leigh-on-Sea, United Kingdom

[73] Assignee: Neopost Limited, Essex, United Kingdom

[21] Appl. No.: 08/792,431

[22] Filed: Jan. 30, 1997

[30] Foreign Application Priority Data

Jan. 31, 1996 [GB] United Kingdom ..... 9601898

[51] Int. Cl.[7] ..... B41J 11/20

[52] U.S. Cl. ..... 400/58; 400/636.3

[58] Field of Search ..... 400/55, 56, 57, 400/58, 59, 120.16, 120.17, 634, 636.1, 636.3, 637.4, 638, 649; 101/91

[56] References Cited

U.S. PATENT DOCUMENTS

| | | | |
|---|---|---|---|
| 4,143,977 | 3/1979 | Kurihara | 400/56 |
| 4,620,807 | 11/1986 | Polit | 400/56 |
| 4,938,129 | 7/1990 | Miciukiewicz | 101/76 |
| 5,156,467 | 10/1992 | Kitahara | 400/58 |
| 5,212,499 | 5/1993 | Hongo | 400/648 |
| 5,339,733 | 8/1994 | Malin | 101/91 |
| 5,355,152 | 10/1994 | Porter et al. | 400/236 |

FOREIGN PATENT DOCUMENTS 0 611 658 of 0000 European Pat. Off. .

*Primary Examiner*—John Hilten
*Attorney, Agent, or Firm*—Shoemaker and Mattare, Ltd.

[57] ABSTRACT

Printing apparatus is disclosed for printing on articles of non-uniform thickness. The printing apparatus includes a thermal transfer print head to print on the article and the article is pressed toward thermal printing elements of the thermal print head by a line of individual impression rollers each individually resiliently biased toward the print head.

9 Claims, 2 Drawing Sheets

THERMAL PRINTING APPARATUS

BACKGROUND OF THE INVENTION

This invention relates to printing apparatus and in particular to thermal printing apparatus wherein ink is transferred from a layer of ink of an ink ribbon by the action of heat on the ink layer.

In some forms of printing apparatus it is necessary to obtain close engagement of the print receiving medium with an ink donating element or ribbon to achieve reliable printing.

One example of such printing apparatus operating in this manner is printing apparatus in which the surface of a print receiving medium is brought into engagement with a print die which may be carried on a rotatable print drum, the print die having been inked prior to engagement thereof by the print receiving medium.

Another example is thermal printing apparatus. Thermal printers are known in which a print receiving sheet is located adjacent a thermal print head with an ink transfer ribbon interposed between the sheet and the print head. Pressure is applied to the sheet to urge the sheet into ink transfer engagement with an ink layer carried by a substrate of the ink ribbon and to urge the substrate of the ink ribbon into heat receiving engagement with thermal printing elements of the print head. The thermal printing elements are heatable selectively by passing electric current therethrough and the heating of the elements results in heating of areas of the ink layer adjacent to heated elements. Heating of the ink layer results in the ink layer adhering more strongly to the surface of the print receiving sheet than to the substrate of the ribbon. Consequently when the used ribbon is peeled from the print receiving sheet, areas of ink layer corresponding to heated elements of the print head remain adhered to the print receiving sheet while the remainder of the ink layer remains adhered to the substrate of the ribbon. The thermal elements are disposed in a column and hence after selective heating of the elements, dots of ink are adhered to the sheet in selected locations in a column. By causing relative movement between the sheet and the print head in a direction transverse to the row of elements and by repeatedly selectively energising the elements, dots of ink are adhered to the sheet column-by-column and a required printed pattern is built up column-by-column. The pattern may be alphanumeric or other characters or may be a pictorial pattern.

It is known to use either rotatable drum print heads or thermal ink transfer printers in postage meters for printing postal indicia on mail items. The indicia generally comprises an invariable pattern together with variable postage data. The variable postage data includes a value of postage charge for the mail item and the date on which the mail item is entered into the postal system. The form of the postal indicia is authorised for use by the postal authority.

In printers for printing on a sheet of paper there is little difficulty in maintaining the sheet in the required engagement with the ink donating element. In thermal printers the sheet can be readily maintained in engagement with the ribbon and the ribbon with the elements of the print head to ensure reliable printing on the sheet. However mail items may not be of uniform thickness and in postage meters it is difficult to ensure that the entire extent of the surface onto which printing is to be effected is subjected to pressure to maintain the surface in engagement with the print die or with the ink layer of the ribbon. Mail items generally consist of an envelope containing inserts. Often the inserts are of generally uniform thickness over the extent of the envelope and hence the overall thickness of the mail item, i.e. the thickness of the inserts together with the thickness of the walls of the envelope, is substantially uniform. Reliable printing can be obtained with such uniform thickness mail items. However some mail items contain inserts of non-uniform thickness. Other mail items contain inserts of less extent than the envelope. Consequently the thickness of some parts of the mail item is determined by the thickness of the inserts and the walls of the envelope while the thickness of other parts of the mail item, to which the inserts do not extend, is determined solely by the walls of the envelope.

The pressure for maintaining the sheet, ribbon and print head in the required engagement with one another is applied between the print head and roller supporting the print receiving sheet. In postage meters where the mail item is fed past a stationary print head, the roller is resiliently mounted and is urged toward the print head. The resilient mounting of the roller enables mail items of different thicknesses to be accommodated. It has been proposed that the roller be deformable at discrete intervals. However if the roller is sufficiently hard to ensure feeding of the mail item at a substantially uniform speed when the roller is rotated at a uniform speed, the roller is insufficiently deformable to apply the required pressure to all parts of a mail item in which there is significant variation of thickness.

SUMMARIES OF THE INVENTION

According to one aspect of the invention printing apparatus for printing on a print receiving item the thickness of said item being non-uniform comprises a print head including a printing element; means for providing a layer of ink for transfer by the printing element to the print receiving item; means operable to feed an item in engagement with the layer of ink; and pressure means including a plurality of separate pressure elements operative independently to apply pressure to the item such as to urge the item into ink transfer engagement with the ink layer; said pressure means being opposed to the printing element and being disposed in a line; said pressure means being effective to obtain the required engagement between the item and the ink layer.

According to a second aspect of the invention thermal ink transfer printing apparatus for printing on print receiving items the thickness of said items being non-uniform comprises a thermal print head including a plurality of selectively energisable thermal printing elements extending in a column; feed means operable to feed an item past the column of thermal printing elements in a direction transverse to said column of elements; ribbon means to guide a thermal ink transfer ribbon having an ink layer between the print receiving item and the thermal printing elements, the ink layer being disposed in engagement with the item; and pressure means including a plurality of separate pressure elements operative independently to apply pressure to the item such as to urge the item into ink transfer engagement with the ink layer of the ribbon and the ribbon into heat transfer engagement with the thermal printing elements; said pressure means being opposed to the column of thermal printing elements and being disposed in a line aligned with the column of thermal printing elements; said pressure means being effective to obtain the required engagement between the item and the ink layer and between the ribbon and the print thermal printing elements of an item, the thickness of said item being non-uniform in a region extending along and adjacent the column of thermal printing elements.

According to another aspect of the invention a postage meter includes thermal printing apparatus as hereinbefore defined.

BRIEF DESCRIPTION OF THE DRAWING

An embodiment of the invention will now be described with reference to the drawings in which.

DESCRIPTION OF THE PREFERRED EMBODIMENT

Figure 1:
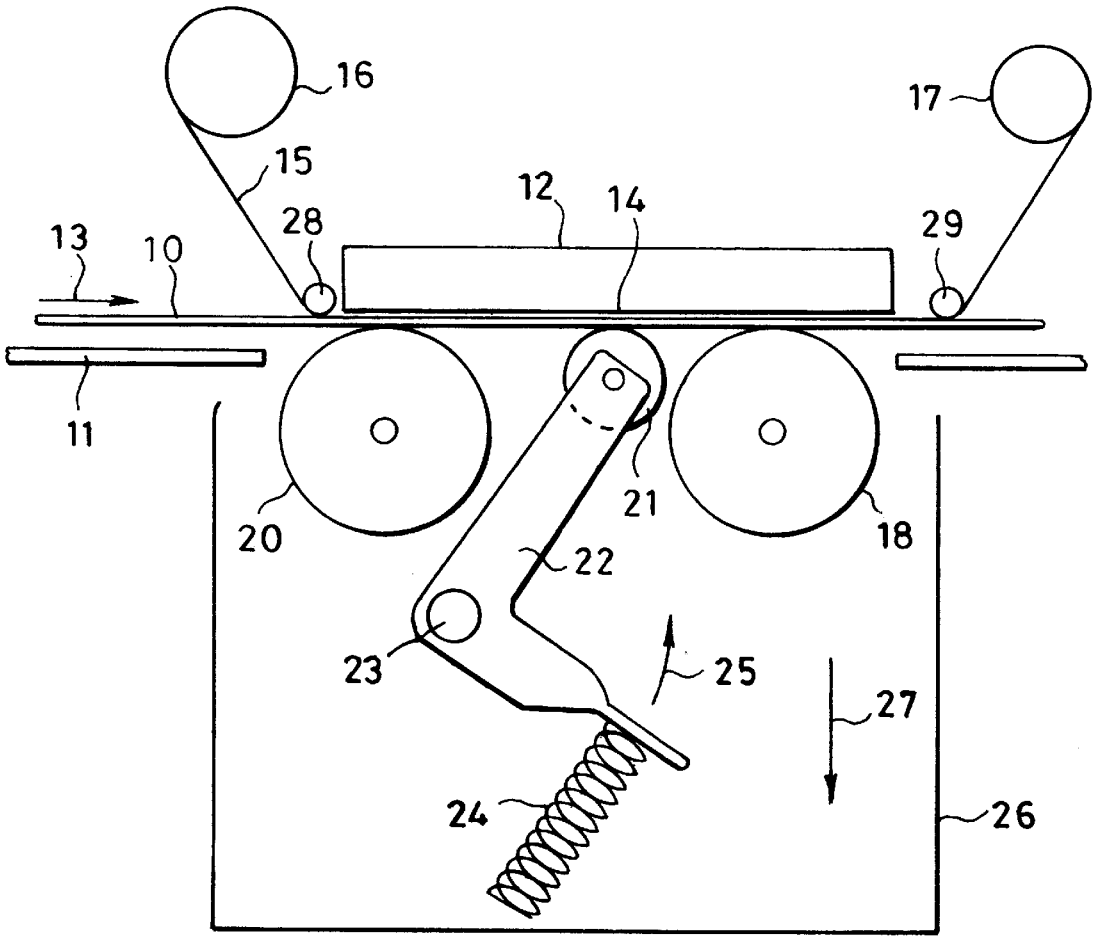
FIG. 1 is a side view of thermal printing apparatus in accordance with the invention.
Figure 2:
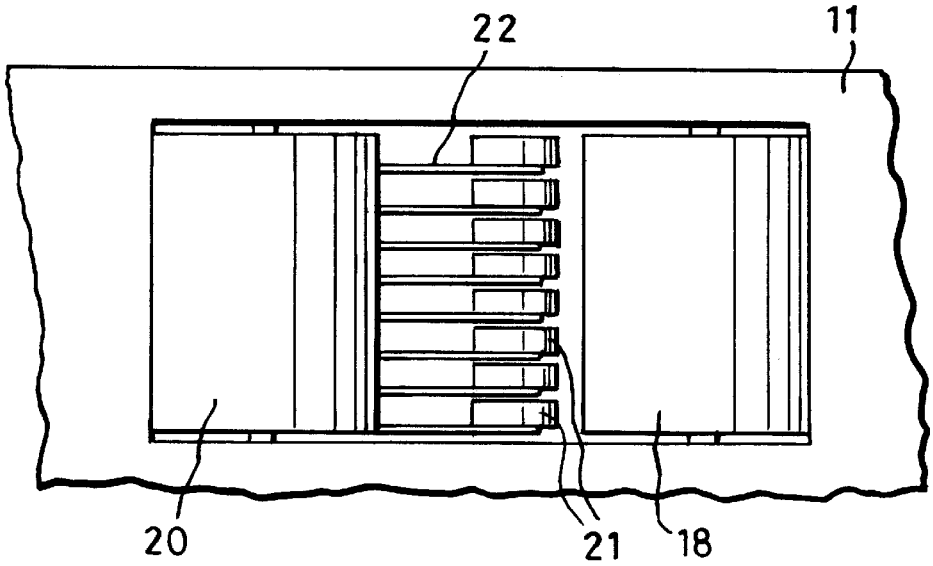
FIG. 2 is plan view of the feed bed of the apparatus shown in FIG. 1.

Referring to FIGS. 1 and 2, a mail item 10 is fed along a feed bed 11 past a thermal print head 12 in the direction of arrow 13. The thermal print head 12 is mounted above and spaced from the feed bed 11 to provide a passage for mail items between the feed bed and the print head. The print head includes thermal printing elements 14 disposed in a column on the lower face of the print head. The column of thermal printing elements extends transversely to the direction of feed of the mail item. A thermal transfer ink ribbon 15 consisting of a layer of ink carried on a substrate passes from a supply reel 16 along the lower face of the print head past the thermal printing elements 14 and thence to a take-up reel 17. Rollers 28, 29 are provided for guiding the ink ribbon before and after passing the print head. The substrate of the ribbon is located adjacent the print head and hence the ink layer is in contact with the upper surface of the mail item. The mail item is fed, in the direction of arrow 13, by means of a feed roller 18 driven by a drive motor 19 (see FIG. 3). The roller 18 is resiliently mounted and is pressed into engagement with the lower surface of the mail item. The mail item is therefore resiliently restrained between the roller and the print head so that frictional engagement of the roller with the mail item is effective to feed the mail item. If desired a further drive roller 20, driven by the motor 19 at the same speed as drive roller 18 and mounted resiliently, may be provided. If desired, the drive roller 18 and the drive roller 20, if provided, may co-operate with fixedly mounted freely rotatable pressure rollers (not shown) instead of with the print head to provide the required pressure to feed the mail item with frictional force. Engagement between the ink layer of the ribbon and the mail item draws the ribbon from the supply reel and feeds the ribbon with the mail item past the printing elements of the print head.

In order to effect printing by transfer of ink from the ink layer of the ribbon to the mail item as a result of heating of the thermal printing elements of the print head, it is necessary to ensure ink transfer relationship between the surface of the mail item and the ink layer of the ribbon and heat transfer relationship between the ribbon and the thermal elements of the print head. A set of impression rollers 21 are provided, the rollers being disposed side by side transverse to the direction of feed of the mail item. The rollers are supported by means of a corresponding set of cradles 22, each roller 21 being mounted independently in a separate cradle of the set. The cradles are pivoted on a common shaft 23. A set of springs 24 act one of each cradle respectively to urge the cradles to pivot in a direction indicated by arrow 25 so as to resiliently urge each impression roller 21 into engagement with the mail item. The impression rollers 21 are disposed approximately coaxially and the peripheries thereof engage the mail item substantially in a line in alignment with the column of thermal printing elements 14. Thus the impression rollers urge the mail item into engagement with the ink ribbon and the ink ribbon into engagement with the print head to enable thermal transfer printing to be effected. Because each impression roller is independently mounted each part of the mail item opposed to the column of thermal printing elements is subjected to pressure by the resiliently mounted impressions rollers such as to ensure the required engagement between mail item and ribbon and between the ribbon and thermal printing elements despite the mail item being non-uniform in thickness across the width of the mail item. For example the mail item may contain one or more inserts which are of less extent than the envelope of the mail item and the inserts do not reach to an upper edge of the mail item. As result a band extending along the length of the mail item adjacent the upper edge of the mail item is thinner than the remainder of the mail item. This band of the mail item may overlap with an area in which it is required to print a franking impression and only partial printing of the franking impression could occur. However by the provision of a plurality of independently and resiliently mounted impression rollers, each roller is enabled to move independently to an extent sufficient to apply the required pressure to the thinner parts of the mail item as well as to the thicker parts of the mail item to ensure that all parts of the upper surface of the mail item are urged into the required engagement with the ink layer of the ribbon and the ribbon into engagement with the thermal printing elements to ensure reliable printing of the entire franking impression. It will be appreciated that the impression rollers 21 are not driven but are freely rotatable.

As hereinbefore described, the thermal printing elements 14 are disposed in a column extending transversely to the direction 13 in which the mail item is fed. Energisation of selected thermal printing elements of the print head in a printing cycle causes heating of areas of the ink layer of the thermal transfer ink ribbon 15 adjacent the energised printing elements. Heating of areas of the ink layer causes those heated areas to adhere more strongly to the mail item than to the substrate backing layer of the ribbon so that, when the ribbon is peeled from the mail item as it passes around guide roller 29 after passing the print head and is drawn onto the take-up reel 17, those areas of the ink layer which have been subjected to heat remain adhered to the mail item to form printed dots in required locations in a column and the remainder of the ink layer which has not been subjected to heat remains adhered to the backing layer of the ribbon as it is peeled from the mail item. The mail item and thermal transfer ink ribbon are fed together past the print head during the printing operation and repeated selection and energisation of selected printing elements in the series of printing cycles results in printing of dots in required positions of a corresponding series of columns spaced along the mail item in the direction of feeding of the item. Accordingly a complete printed impression is built up in a column-by-column manner in the series of printing cycles of a printing operation.

Conveniently the feed rollers 18, 20 and the cradles for the impression rollers are mounted on a common sub-chassis 26 of the printing apparatus. The sub-chassis is movable in a downwards direction, indicated by arrow 27 so as to retract the feed rollers 18, 20 and the impression rollers 21 into inoperative positions after printing on the mail item has been completed to permit withdrawal of mail item from the printing apparatus and to facilitate entry of the next mail item into the printing apparatus. When the next mail item is located for the commencement of printing thereon, the sub-chassis is raised to bring the rollers 18, 20 and the impression rollers 21 into their operative positions to perform as described hereinbefore.

It will be appreciated that the cradles 22 may be constructed so as to enable the springs to be accommodated within the width of the rollers 21. For example if desired alternate cradles may have a first form and cradles located therebetween may have a second form different from the first whereby the springs associated with the alternate cradles of first form are off set relative to the springs associated with the cradles of second form. It preferred to provide a plurality of rollers engaging the mail item because they cause less frictional drag on the mail item than non-rotatable means. However, if desired, other forms of means for applying pressure to the mail item may be provided. For example a plurality of fingers may be pivotally mounted to be urged by spring pressure or resilience of the fingers to exert pressure on the mail item.

It is to be understood that while the description of the embodiment includes terms relating to the orientation of the apparatus, the apparatus may have any desired orientation and for example the plane of the feed bed may lie in a vertical plane.

Figure 3:
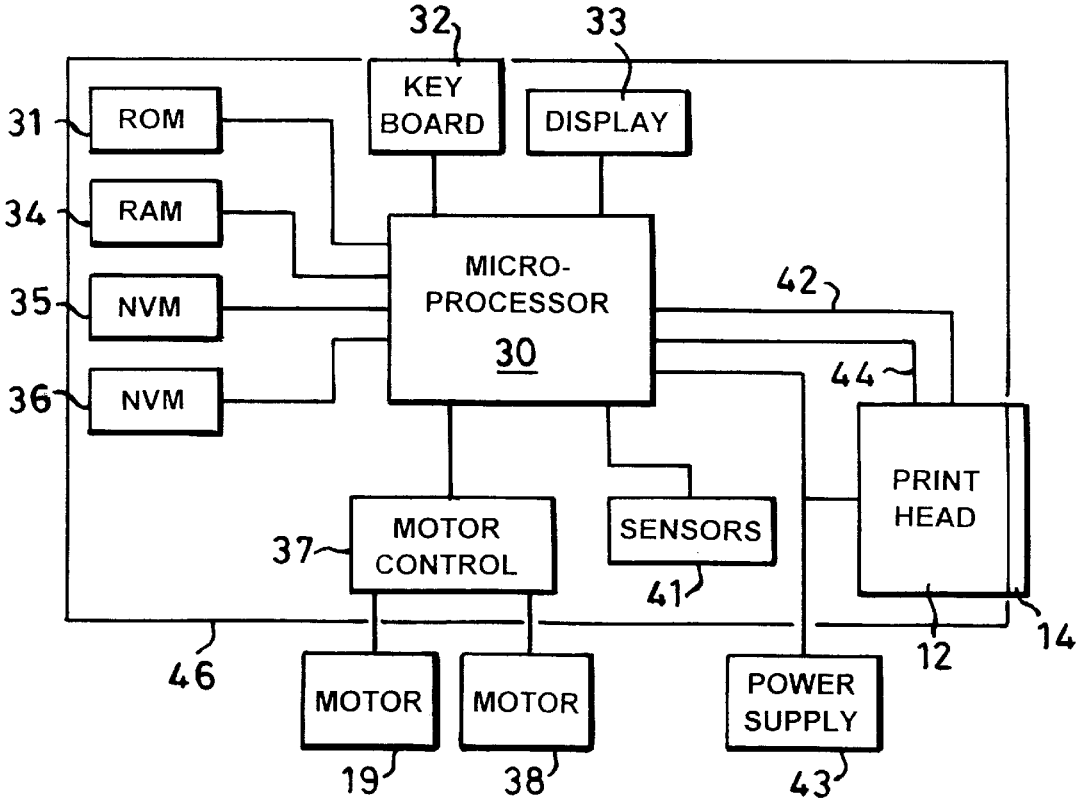
FIG. 3 is a block diagram of a postage incorporating the printing apparatus of FIGS. 1 and 2.

Referring now to FIG. 3, the postage meter includes electronic accounting and control means comprising a micro-processor 30 operating under program routines stored in a read only memory (ROM) 31. A keyboard 32 is provided for input of commands and data by a user and a display 33 is provided to enable display of information to the user. A random access memory (RAM) 34 is provided for use as a working store for storage of temporary data during operation of the postage meter. Non-volatile duplicated memories 35, 36 are provided for the storage of critical data relating to use of the postage meter and which is required to be retained even when the postage meter is not powered. The microprocessor 30 carries out accounting functions in relation to use of the postage meter for franking mail items with postage charges applicable to handling of the mail items by the postal authority or another carrier. Accounting data relating to use of the postage meter for printing franking impressions representing postage charges for mail items and any other critical data to be retained is stored in the non-volatile memories 35, 36. The accounting data includes a value of credit available for use by the meter in franking mail items, an accumulated total of value used by the meter in franking mail items, a count of the number of mail items franked by the meter and a count of the number of mail items franked with a postage charge in excess of a predetermined value. The value of credit is stored in a descending credit register, the accumulated total value is stored in an ascending tote register, the count of items is stored in an items register and the count of items franked with a postage charge in excess of a predetermined value is stored in a large items register. As is well known in the postage meter art, each of the registers referred to hereinbefore for storing accounting data is replicated in order to enable integrity of the accounting data to be maintained even in the event of a fault or termination of power to the meter during a franking operation. Two replications of each of the registers are provided in each of the memory devices 35, 36.

A motor controller 37 is controlled by the microprocessor 30 to control operation of the motor 19 driving the feed rollers 18, 20 for feeding the mail item past the thermal print head 12 and of a motor 38 for driving the take-up reel such as to tension the used ribbon sufficient to peel the used ribbon from the mail item as the ribbon passes round the guide roller 29. The thermal printing elements 14 of the print head 12 are selectively energisable by the microprocessor 30. Sensors 41 are provided to sense and monitor feeding of the mail item. The sensors provide signals to the microprocessor to enable the microprocessor to control feeding of the mail item and to selectively energise the thermal print elements 14 of the print head at appropriate times as the mail item is fed past the print head. As the mail item is fed past the thermal printing elements 14 of the print head 12 during a printing operation, the microprocessor outputs on line 42, in each of a series of printing cycles, print data signals selecting those ones of the printing elements 14 which are to be energised in each respective printing cycle. A pulse of electrical power is supplied to the selected thermal printing elements from a power source 43 when a strobe signal is supplied by the microprocessor on a line 44 to the print head.

It will be appreciated that, as is well known in the postage meter art, the postage meter must operate in a secure manner and be protected from attempts to use the meter fraudulently for example by utilising the postage meter to print franking impressions on mail items for which no corresponding postage charge has been accounted for by the accounting means. Accordingly those parts of the postage meter required to be secured against unauthorised tampering are housed in a secure housing 46.

In so-called prepayment operation of a postage meter, the descending register of the meter is set with a value of credit which is then available for use in franking mail items and, as each mail item is franked with a postage charges, the value in the descending register is decremented by the amount of the postage charge. Each time a franking operation is to be performed, the microprocessor carries out a routine in which a determination is made as to whether the value of credit in the descending register is sufficient to cover the cost of the postage charge intended to be applied in respect of the mail item. If the value in the descending register is sufficient the franking operation is continued and the values in the registers are updated to account for the postage charge and the franking impression is printed. However if the value of credit in the descending register is less than the postage charge intended to be applied to the mail item, the routine is terminated and the franking impression is not printed. Generally, if the microprocessor determines that the value of credit in the descending register is less than a predetermined value, the microprocessor terminates the current franking operation and locks the postage meter from further use in franking mail items until such time as the value of credit in the descending register has been reset to a higher value.

While the embodiment of the invention described hereinbefore includes thermal printing apparatus in which ink is transferred by thermal action on a thermal ink transfer ribbon, it is to be understood that the invention may be utilised in respect of other forms of printing apparatus in which it is required that the surface of a mail item intended to receive a print impression is brought into intimate engagement under pressure with a printing element or elements.

I claim:

1. Printing apparatus for printing on a print receiving surface of an item during feeding of the item in a feed direction, said item being of nonuniform thickness in a direction transverse to the feed direction, said apparatus comprising a print head including printing means extending along a line; means providing a layer of ink for transfer by the printing means to a surface of the print receiving item; and feed and impression means operable to feed the item past the printing means in the feed direction; said line of printing means extending transversely to said feed direction and while feeding the item to press the item toward the printing means into ink transfer engagement with said layer of ink; said feed and impression means including a plurality of freely rotatable impression rollers having axes extending transversely to the feed direction and engageable tangentially with the item in opposition to the printing means, said impression rollers each being independently and resiliently mounted to accommodate the non-uniform thickness of the item transversely of the feed direction; a driven feed roller engageable with said item downstream of and adjacent said plurality of impression rollers; said feed and impression means having an inoperative retracted position in which both the feed roller and the plurality of impression rollers are spaced from the printing means to permit free passage of a print receiving item past the feed roller and between the printing means and the plurality of impression rollers and an operative position in which the plurality of impression rollers press the surface of the item into ink transfer engagement with the ink layer and the feed roller engages the print receiving item to feed the item past the printing means; means operable to move said feed and impression means from said inoperative position to said operative position in a printing operation when the print receiving item is located between the printing means and the plurality of impression rollers to receive a printed impression thereon.

2. Printing apparatus as claimed in claim 1 wherein each resilient mounting means includes a cradle supporting an associated one of the pressure rollers; each cradle being pivotally supported; and resilient spring means acting on the cradle to urge the roller carried thereby toward the printing element.

3. Printing apparatus for printing on a print receiving surface of an item during feeding of the item in a feed direction, said item being of non-uniform thickness in a direction transverse to the feed direction, said apparatus comprising a thermal print head including a plurality of selectively energisable thermal printing elements located in a line on a substrate; ink ribbon means to guide a thermal transfer ink ribbon in heat transfer engagement with the thermal printing elements; and feed and impression means operable to feed the item past the line of thermal printing elements in the feed direction; said line of thermal printing elements extending transversely to said feed direction and while feeding the item to press the item toward the thermal printing elements to produce ink transfer engagement of the surface with a layer of ink carried by said ink ribbon; said feed and impression means including a plurality of freely rotatable impression rollers having axes extending transversely to the feed direction and engageable tangentially with a rear surface of the item in opposition to the line of thermal printing elements, said rear surface being spaced from said print receiving surface by the non-uniform thickness of the item; said impression rollers each being independently and resiliently mounted to accommodate the non-uniform thickness of the item transversely to the feed direction and effective to act on the rear surface and thereby press the print receiving surface of the non-uniform thickness item into engagement with the ink layer; a driven feed roller engageable with said rear surface of the item downstream of and adjacent said plurality of impression rollers; said feed and impression means having an inoperative retracted position in which both the feed roller and the plurality of impression rollers are spaced from the printing means to permit free passage of a print receiving item past the feed roller and between the printing means and the plurality of impression rollers and an operative position in which the plurality of impression rollers press the surface of the item into ink transfer engagement with the ink layer and the feed roller engages the print receiving item to feed the item past the printing means; means operable to move said feed and impression means from said inoperative position to said operative position in a printing operation when the print receiving item is located between the printing means and the plurality of impression rollers to receive a printed impression thereon.

4. Printing apparatus as claimed in claim 3 wherein each resilient mounting means includes a cradle supporting an associated one of the pressure rollers; each cradle being pivotally supported; and resilient spring means acting on the cradle to urge the roller carried thereby toward the printing element.

5. Printing apparatus as claimed in claim 3 wherein the feeding means includes a further feed element located upstream, in the direction of feeding of the item, of the thermal printing elements and of the pressure means operable to engage and feed the item toward the thermal printing elements in a printing operation.

6. Printing apparatus as claimed in claim 3 including a chassis member movable toward and away from the thermal printing elements; said feed and impression means being carried on said chassis member.

7. Printing apparatus as claimed in claim 3 wherein the feed roller is mounted in opposition to the substrate of the thermal print head and wherein in the operative position of the feed and impression means the print receiving item and the ink ribbon are engaged between the feed roller and the substrate of the thermal print head.

8. Printing apparatus as claimed in claim 3 wherein the feed and impression means includes an additional driven feed roller located upstream of and adjacent the plurality of impression rollers.

9. Printing apparatus as claimed in claim 7 wherein the feed and impression means includes an additional driven feed roller located upstream of and adjacent the plurality of impression rollers, said additional driven feed roller being located in opposition to the substrate of the thermal print head and wherein in the operative position of the feed and impression means the print receiving item and the ink ribbon are engaged between the feed roller, the plurality of impression rollers and the additional driven feed roller and the substrate of the thermal print head.

* * * * *